US006290005B1

(12) United States Patent
Klemm

(10) Patent No.: US 6,290,005 B1
(45) Date of Patent: Sep. 18, 2001

(54) PNEUMATIC IMPACT DAMPING DEVICE FOR A DRILL COLUMN

(76) Inventor: Guenter Klemm, Gray 21, 9572, Deutsch-Griffen (AT)

( * ) Notice: Subject to any disclaimer, the term of this patent is extended or adjusted under 35 U.S.C. 154(b) by 0 days.

(21) Appl. No.: 09/459,938

(22) Filed: Dec. 14, 1999

(30) Foreign Application Priority Data

Dec. 14, 1998 (DE) ..... 198 57 479

(51) Int. Cl.[7] ..... E21B 17/04
(52) U.S. Cl. ..... 175/296; 175/321
(58) Field of Search ..... 175/67, 92, 296, 175/321, 325, 299, 322

(56) References Cited

U.S. PATENT DOCUMENTS 4,055,338 10/1977 Dyer .
4,194,581 * 3/1980 Walter ..... 175/92
4,231,283 * 11/1980 Malburg ..... 175/67 X
4,257,245 * 3/1981 Toelke et al. ..... 175/321 X
5,355,966 10/1994 Mathis .
5,715,897 * 2/1998 Gustafsson ..... 175/296

FOREIGN PATENT DOCUMENTS 19616751 4/1996 (DE) .

* cited by examiner

*Primary Examiner*—Frank S. Tsay
(74) *Attorney, Agent, or Firm*—Diller, Ramik & Wight

(57) ABSTRACT

A pneumatic impact damping device for a drill column comprises a first connection member for connection with the rear part of a drill column and a second connection member for connection with the front part of the drill column. Both connection members define a pneumatic cylinder chamber through which a bushing extends. The bushing has a passage moving Into and closed by a seal when an axial thrust force is exerted on the drill column. Thus, pressurized air is trapped and compressed in the cylinder chamber. In this manner, impacts applied to the front connection member by a deep-hole hammer drill are damped and prevented from acting on the rear part of the drill rod.

15 Claims, 3 Drawing Sheets

PNEUMATIC IMPACT DAMPING DEVICE FOR A DRILL COLUMN

TITLE OF THE INVENTION

A pneumatic impact damping device for a drill column

BACKGROUND OF THE INVENTION

The present invention relates to a pneumatic impact damping device for a drill column, and, in particular, to an impact damping device used with a deep-hole hammer drill to divert the impacts and vibrations of the drill from the rotating machine rotating the drill column and from other parts of the drilling equipment.

U.S. Pat. No. 5,355,966 describes a drilling means with a deep-hole hammer drill at an inner drill column and a rotary percussion drill at an outer drill column. An impact damping device is provided that separates the impacts from the inner and the outer tube, respectively.

From German Patent 196 16 751, a device for superposed drilling is known wherein an outer column is connected with a head-piece onto which an percussion device may strike. Within the head-piece, a gas pressure reservoir is located having a hydraulic chamber in communication with a cylinder chamber. The hydraulic liquid In the cylinder chamber pushes forward a hydraulic piston to which the inner column is connected. The gas pressure reservoir separates the inner column, with the deep-hole hammer drill contained therein, from the impacts caused by the percussion device.

It is common with drill columns operated with a deep-hole hammer drill to arrange a pack of damping elements in front of the rotary drive, the elements keeping the deep-hole hammer drill impacts away from the rotary drive. The damping elements are rubber packages subjected to heavy wear.

A pneumatic impact damping device of the kind mentioned in the preamble of claim 1 is known from U.S. Pat. No. 4,055,338. This damping device comprises a cylinder chamber filled with gas, e.g. hydrogen, and sealed off by a piston. The piston is supported by a liquid buffer. Upon an axial movement of the cylinder, which is connected with a first portion of a drill column, the gas within the gas chamber is compressed thereby producing a spring and damping effect. This device has a gas chamber that is always closed, and it also has a liquid chamber always closed. Thus, it requires a certain maintenance to ensure the required volumes of gas and liquid.

It is the object of the present invention to provide a pneumatic impact damping device that is of simple structure and is functionally reliable while having a long service life.

SUMMARY OF THE INVENTION

The present impact damping device comprises a cylinder in which a piston is movable. The piston and the cylinder are penetrated by a longitudinally extending channel through which pressurized air may flow for supplying a connected deep-hole hammer drill with pressurized air. From the channel that carries the pressurized operating air, a passage extends into the cylinder chamber. This passage is closed off automatically when an axial thrust force is exerted from the rear end onto the drill column. Closing off the passage traps the pressurized air contained in the cylinder chamber, the air being compressed subsequently. The air flowing in the channel of the drill column is used as the pressure gas so that no closed gas pressure reservoir is needed. Neither is a closed liquid chamber needed. With the air trapped in the cylinder space, ain air cushion is formed that absorbs impacts. This air cushion is pre-stressed by the supply pressure of the pressurized air and also by the axial thrust force so that it can effectively dampen impacts and vibrations. The pre-compressed pressure may increase to a multiple of the operating pressure by closing the passage. Thus, the damping device may be made more compact.

According to a preferred development of the invention, the cylinder chamber contains a spring device pressing on the piston. This spring device tends to enlarge the cylinder chamber. It supports the damping effect of the pneumatic air cushion. Moreover, it presses the cylinder chamber apart when the thrust force is released. This guarantees that the impact damping device does not remain in the compressed state, but is always relaxed and open when used again.

In a preferred embodiment, the cylinder chamber includes a longitudinally extending bushing projecting through the piston and being provided with the passage in the form of at least one hole in the wall. This bushing is the channel for the pressurized air flowing through the drill column. At the same time, it acts as a control element to close off the cylinder chamber when a thrust force acts thereon.

The invention is generally applicable to drill columns, both double drill columns and single drill columns. Double drill columns have an inner tube and an outer tube rotated by a common rotary drive or by separate rotary drives.

BRIEF DESCRIPTION OF THE DRAWINGS

The following is a detailed description of embodiments of the invention with reference to the accompanying drawings, in which.

DETAILED DESCRIPTION OF PREFERRED EMBODIMENTS

Figure 1:
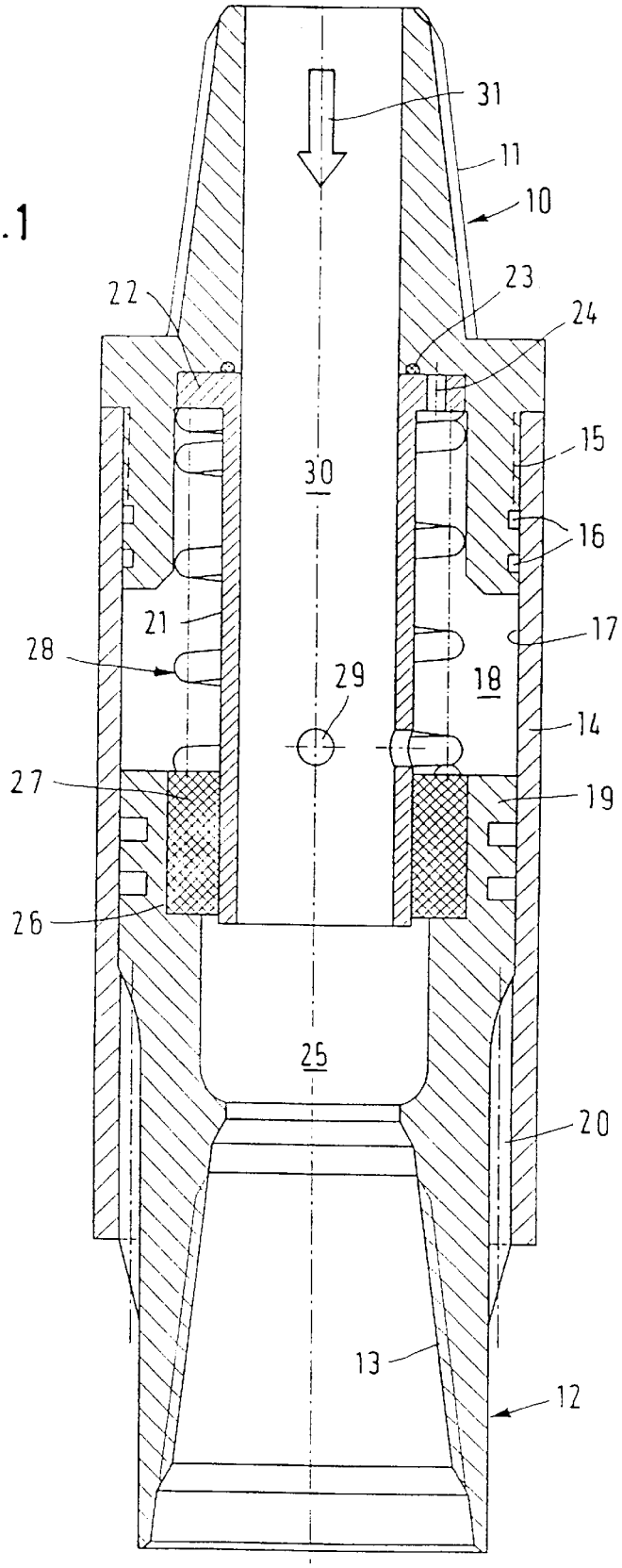
FIG. 1 is a longitudinal section through an impart damping device in the relaxed state.
Figure 2:
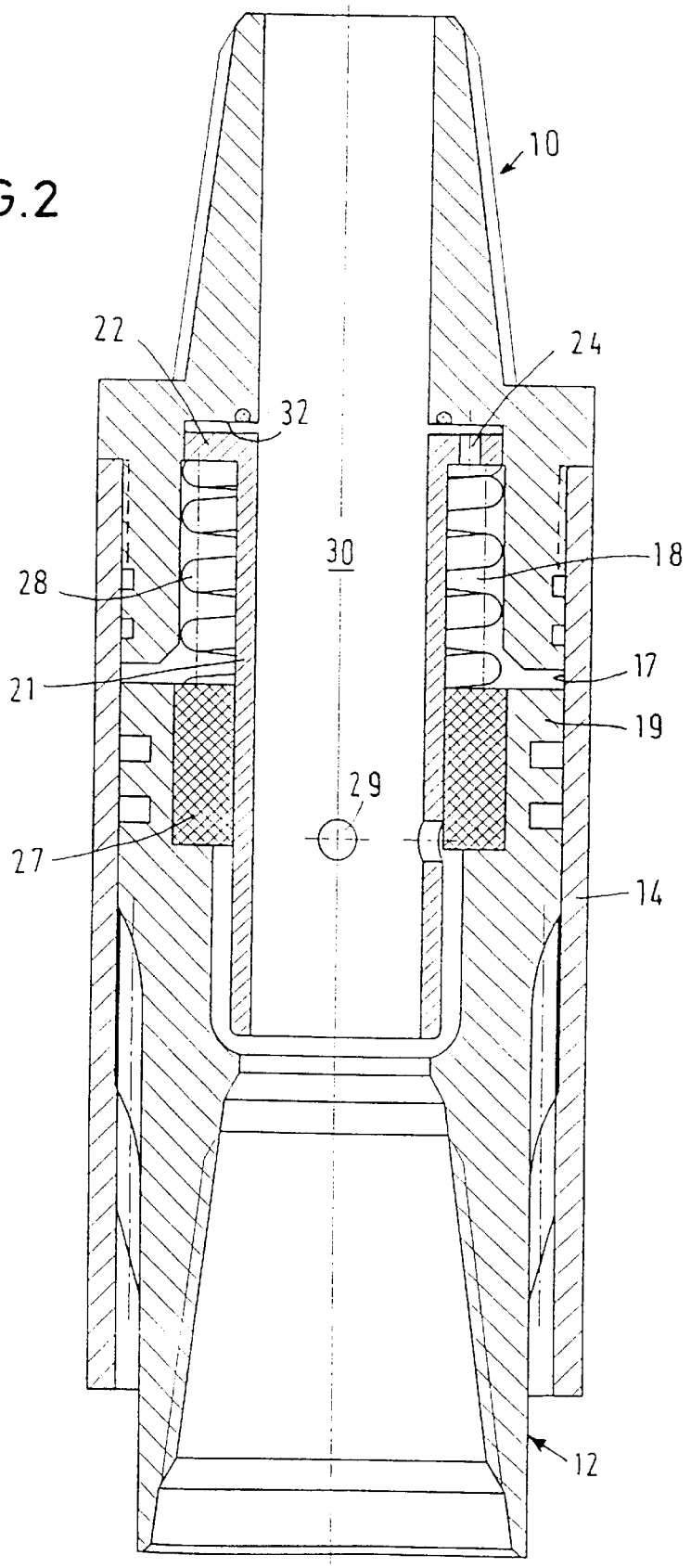
FIG. 2 illustrates the impact damping device of FIG. 1 in the loaded state.

The impact damping device of FIGS. 1 and 2 comprises a first connection member 10 for connection to the rear part of a drill column and having an outer thread 11 for this purpose, which in the present case is shaped as a conical thread. Further, the device comprises a second connection member 12 with an inner thread 13 for connection to a front part of the drill column, i.e. either to a drill pipe or directly to a deep-hole hammer drill.

Screwed to the connection member 10 is a cylindrical sleeve 14 having a thread 15, the joint between the connection member and the sleeve being sealed by seals 16. Together with the sleeve 14, the connection member 10 forms a cylinder 17 with a cylinder chamber designated as 18. A piston 19 moves within this cylinder 17, the piston being part of the second connection member 12. The exterior of the second connection member 12 has a wedge-shaped toothing 20 engaging a corresponding counter toothing in the sleeve 14 so that the second connection member 12 is secured against rotation in the sleeve 14, yet it is axially movable.

The cylinder chamber 18 includes a bushing 21 abutting the end wall of the cylinder chamber 18 with a flange 22, where it is sealed by a ring seal 23. The flange 23 is provided with a continuous axial bore 24. The bushing 21 extends in to the piston 19. The connection member 12 has a continuous axial bore 25 extending through the piston 19. In an enlarged portion 26 of the bore 25, a seal 27 in the form of a gland. The bushing 21 extends through this seal 27. The bushing is surrounded by a spring device 28 in the form of a helical spring supported at one end on the flange 22 arid, at he other end, on the front end side of the seal 27. The higher the pressure force of the spring device 28, the greater the axial compression of the seal 27 for increasing the radial pressing force on the bushing 21.

The bushing 21 has a passage 29 in the form of at least one hole in the wall. This passage forms a control opening for the connection of the cylinder chamber 18 to the channel 30 extending through the bushing and thus also through the cylinder and the piston.

Pressurized air can flow through the channel 30 in the direction of the arrow 31 through the drill column to the deep-hole hammer drill connected with the connection member 12. The pressure of the pressurized air is about 10 bar. The cylinder chamber 18 is filled with pressurized air. When an axial thrust force or pressing force is applied to press the drill bit against the bottom of the drill hole, the spring device 28 is compressed, whereby the piston 19 penetrates deeper into the cylinder chamber 18. Here, the passage 29 is closed by the seal 27 and the pressurized air in the cylinder chamber 18 is compressed even more, for example to 15 bar. This is the active state of the impact damping device in which impacts and vibrations transferred to the second connection member 12 are absorbed and thus do not reach the first connection member 10.

When the axial thrust force is no longer active, the spring device 28 tends to enlarge the cylinder chamber 18 again. A vacuum may result in the cylinder chamber 18 that prevents the spring device 28 from relaxing to a degree that would open the passage 29. To prevent this, a vent opening 24 is provided in the flange 22. With a vacuum in the cylinder chamber, the flange 22 is lifted from the end wall 32 so that pressurized air may flow from the channel 30 through the vent opening 24 into the cylinder camber (18).

Figure 3:
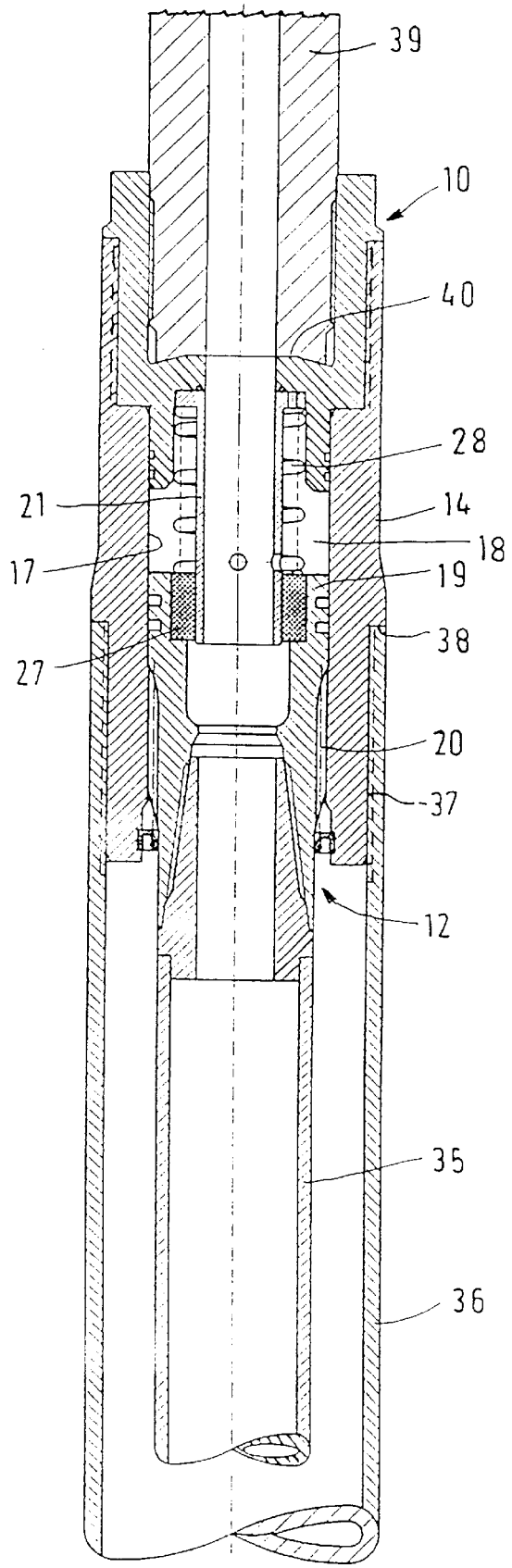
FIG. 3 illustrates a second embodiment of the relaxed impact damping device in a double drill column.

In the embodiment of FIGS. 1 and 2 the impact damping device is installed in a single drill column. FIG. 3 illustrates another embodiment, wherein the impact damping device is connected to an inner column 35 and an outer column 36. The outer column 36 is threaded onto the sleeve 14 by means of a thread 37, an impact transmission surface 38 transmitting the impacts of an outer hammer. These impacts are transmitted from an insert end 39, screwed to the first connection member 10, via an impact transmission surface 40 onto the first connection member. Thus, there is an impact transmission link from the insert end to the outer column 36. The inner column 35 is threaded into the second connection member 12. A deep-hole hammer drill (not illustrated) is arranged at the lower end of the inner column 35. The impact damping device prevents impacts from the deep-hole hammer drill from being transmitted to the insert end 39. Moreover, it is prevented that impacts from the insert end 39 are transmitted to the inner column.

The invention obliterates external impact damping devices that are usually provided in the immediate vicinity of the rotary drive. The impact damping is already effected along the drill column.

What is claimed is:

1. A pneumatic impact damping device for a drill column comprising a cylinder adapted to be connected with a first member of the drill column, said cylinder defining a cylinder chamber, said cylinder being adapted to be connected to a second member of the drill column, said second member including a piston slidable within the cylinder chamber, a channel extending through the cylinder and the piston and pneumatically connecting both parts of the drill column, a passage extending from the channel into the cylinder chamber, and the passage being closed by the movement of the piston due to an axial thrust force.

2. The impact damping device of claim 1, wherein the cylinder chamber comprises a spring device pressing against the piston.

3. The impact damping device of claim 1, wherein the cylinder chamber has a longitudinally extending bushing extending through the piston and being provided with the passage in the form of at least one wall opening.

4. The impact damping device as defined in of claim 3 wherein the piston contains a seal that surrounds the bushing with the bushing being moveable into the seal to close the passage.

5. The impact damping device as defined in claim 1 wherein a first connection member is provided for the first member of the drill column and a second connection member is provided for the second member of the drill column, and one of the connection members being connected with a sleeve that encloses the other connection member slidably and in a manner secured against rotation.

6. The impact damping device as defined in claim 1 wherein the cylindrical chamber includes a longitudinally extending bushing having a vent opening which, when the two members of the drill column are pulled apart, connects the cylinder chamber with the channel.

7. The pneumatic impact damping device as defined in claim 1 wherein said piston includes an axial bore, a bushing carried by a sleeve, said sleeve being adapted to be connected to the first member and enclosing the second member, said bushing having an end portion projecting into said piston axial bore, and a seal located between said bushing end portion and said piston.

8. The pneumatic impact damping device as defined in claim 7 wherein said passage is closed by said seal upon relative inward telescopic movement of said piston relative to said cylinder and is opened by said seal upon relative outward telescopic movement of said piston relative to said cylinder.

9. The pneumatic impact damping device as defined in claim 8 including means for axially slidably and non-rotatably connecting one of said cylinder and piston to one of first and second members of a drill column.

10. The pneumatic impact damping device as defined in claim 7 including means for axially slidably and non-rotatably connecting one of said cylinder and piston to one of first and second members of a drill column.

11. The pneumatic impact damping device as defined in claim 7 including means for axially slidably and non-rotatably connecting said piston to one of first and second members of a drill column.

12. The pneumatic impact damping device as defined in claim 1 wherein said passage is closed by said seal seated within an axial bore of said piston and in external surrounding relationship to a bushing carried by said sleeve.

13. The pneumatic impact damping device as defined in claim 12 including means for axially slidably and non-rotatably connecting one of said cylinder and piston to one of first and second members of a drill column.

14. The pneumatic impact damping device as defined in claim 1 including means for axially slidably and non-rotatably connecting one of said cylinder and piston to one of first and second members of a drill column.

15. The pneumatic impact damping device as defined in claim 1 including means for axially slidably and non-rotatably connecting said piston to one of first and second members of a drill column.

* * * * *